US006048083A

United States Patent [19]

McDermott

[11] Patent Number: 6,048,083

[45] Date of Patent: Apr. 11, 2000

[54] BENT FOCAL LINE LIGHTING DEVICE

[76] Inventor: Kevin McDermott, 196 Phillips Dr., Hampstead, Md. 21074

[21] Appl. No.: 08/497,247

[22] Filed: Jun. 30, 1995

[51] Int. Cl.[7] ..... F21V 5/00

[52] U.S. Cl. ..... 362/337; 362/244; 362/340; 362/800

[58] Field of Search ..... 362/227, 237, 362/337, 800, 311, 332, 336, 338, 339, 340, 244

[56] References Cited

U.S. PATENT DOCUMENTS

| | | | |
|---|---|---|---|
| 801,766 | 10/1905 | Churchill | 362/337 |
| 849,977 | 4/1907 | Churchill | 362/337 |
| 974,123 | 11/1910 | Churchill | 362/337 |
| 1,081,210 | 12/1913 | Churchill | 362/337 |
| 1,759,609 | 5/1930 | Eskilson | 362/337 |
| 2,395,756 | 2/1946 | Parsons | 362/337 |
| 2,454,332 | 11/1948 | Mitchell et al. | 362/337 |
| 3,344,264 | 9/1967 | Perkins | 362/237 |
| 4,654,629 | 3/1987 | Bezos et al. . | |
| 4,941,072 | 7/1990 | Yasumoto . | |
| 5,122,943 | 6/1992 | Pugh | 362/800 |
| 5,140,220 | 8/1992 | Hasegawa | 362/800 |
| 5,224,773 | 7/1993 | Arimura | 362/227 |
| 5,289,082 | 2/1994 | Komoto | 362/800 |
| 5,408,395 | 4/1995 | Schmid et al. | 362/800 |
| 5,607,227 | 3/1997 | Yasumoto et al. | 362/800 |
| 5,608,290 | 3/1997 | Hutchisson et al. | 362/800 |

*Primary Examiner*—Laura K. Tso

*Attorney, Agent, or Firm*—McAulay Nissen Goldberg Kiel & Hand, LLP

[57] ABSTRACT

A bent focal line electronic lighting device for use as a signal or illuminator. Light is created by a plurality of light emitting diode elements. An optic contoured to create a plurality of focal points which form a bent or crooked focal line cooperate with the orientation of the light emitting diode elements to project a composite light beam with limited divergence about a first reference plane. The intensity of the projected light beam is maximized through the efficient collection of created light.

23 Claims, 3 Drawing Sheets

BENT FOCAL LINE LIGHTING DEVICE

BACKGROUND OF INVENTION

Typical of prior art for a wide angle lighting device would be a circular cylindrical fresnel lens in combination with an incandescent lamp as can be found on the buoy lights used to navigate boats.

In this prior art design a cylindrical fresnel or plano-convex lens is formed into a circular pattern about a vertical centerline. This classical buoy light lens is contoured in the vertical plane so that it defines a single focal point located on the vertical centerline. The single focal point is also at the center of the circular pattern formed at the intersection of the horizontal plane and the lens. The incandescent lamp is positioned at the single focal point so that light emerges from the lens with a projected beam pattern that includes a 360 degree beamwidth in the horizontal plane and minimal beamwidth in the vertical plane. This design collects light created by the incandescent source which is emitted at substantial angles above and below the horizontal plane and redirects this light so that it becomes almost parallel to the horizontal plane thus forming an intense beam. Since the incandescent lamp emits light in a substantially uniform spatial radiation pattern the light collected and projected by the lens is substantially uniform in all azimuthal directions of the 360 degree horizontal beam.

A second prior art design also uses the same circular buoy light lens including a single focal point but instead of a single incandescent lamp this configuration incorporates a group of light emitting diode (LED) lamps with lens top bodies. The LED lamps are assembled in a circular formation so that their individual concentrated light beams are directed radially outward from the center of the buoy light lens. The center of the circular formation of LED lamps is coincident with the single focal point of the lens. The single focal point of the buoy light lens works poorly with a plurality of light sources because each of the LED lamps is located at a distance from the single focal point. Since each LED lamp is separated from the focal point, it cannot have its emitted light concentrated into the intense almost parallel beam that could be achieved if it were at the focal point. Generally, the greater the distance between a light source and the focal point the greater the divergence about the horizontal plane of the refracted light emerging from the lighting device. In order to overcome the off-focus location of the LED light sources and achieve acceptably low divergence about the horizontal plane, the body of each LED lamp is contoured to form a lens. The lens on the body of each lamp concentrates the light emitted from the LED element. Although this design uses efficient LED lamps, it is inefficient. Much of the light emitted by the LED element is misdirected within the individual LED lamps due to internal reflection within the bodies of the LED lamps. This internal reflection is related to the light concentrating lens on the body of the LED lamp. Configuring the body of the LED lamp to form a light concentrating lens alters the spatial radiation pattern of the light as it emerges from the body of the lamp. The directional widely divergent spatial radiation pattern of the light emitted from the LED element is altered by the lens so that the light emerging from the LED lamp is directional and concentrated. This alteration is necessary for this prior art design because the buoy light lens cannot—due to the off-focus location of each light source—adequately concentrate the widely divergent light from each LED element. Prior art therefore employs the lens top body of the LED lamp to initiate the concentrating of the light as it leaves the LED lamp body leaving the buoy light lens to complete the concentrating task to finally emit light with minimal divergence about the horizontal plane. Unfortunately, the LED body lens creates several optical problems. Light emerging from the LED body through the body lens and within the concentrated beam pattern appears to the buoy light lens to be emitted from a location different from the location of the LED element. Light emerging from the LED body exterior to the body lens appears to the buoy light lens to be emitted from a multiplicity of points. Thus the light source or LED element appears to the buoy light lens to be larger than its actual size and at multiple locations. It is difficult for any optic to adequately concentrate light emitted from an apparent multiplicity of locations. The buoy light lens of prior art with its single focal point is inadequate for this task.

A third prior art design incorporates a plurality of lens top LED lamps located on the straight horizontal focal line of a straight cylindrical plano-convex lens. Each LED lamp is at the focal point of the lens contour immediately in front of it and light rays emitted by the LED lamp in the vertical plane normal to the lens are refracted to emerge parallel to the horizontal plane. This design is also not efficient because light rays emerging from the LED lamp at azimuthal angles of deviation from the geometric axis of the lamp, intersect the lens to form a contour which defines a focal point at an unacceptably large distance from the LED element. This causes an unacceptable divergence of the light emerging from the plano-convex lens about the horizontal plane. The magnitude of the unacceptable divergence increases as the angle of deviation of the light emerging from the axis of the LED lamp increases. This unacceptable divergence is generally so large that it is difficult to create an emitted light beam of the required concentration or intensity. The lens top body which is included with the LED lamp does help mitigate this problem because it concentrates much of the light emitted by the LED element into a small beam. This reduces the azimuthal divergence of the light emitted from the LED lamp before it impinges upon the plano-convex lens. However the lens top body is counterproductive because it increases the percentage of light lost through Internal reflection within the LED lamp.

SUMMARY OF INVENTION

A plurality of light sources incorporating light emitting diode (LED) elements are used in cooperation with an optic to construct a device which concentrates a maximum amount of the created light into a composite light beam with limited divergence about the horizontal plane. In order to achieve its design objective the optic must define a plurality of focal points. The locus of the focal points forms a bent or curved focal line.

For the purpose of this patent application each focal point of the lens or optic is defined by the intersection lens contour formed at the intersection of the optic and a refraction reference plane. Thus each focal point is related to a refraction reference plane intersection optical contour and a refraction reference plane. There are numerous distinct refraction reference planes that can be drawn for an optic but all are perpendicular to a common first reference plane which is usually the horizontal plane. If a refraction reference plane additionally intersects a LED element then it is considered related to both that LED element and the LED lamp which includes that LED element. If a refraction reference plane is normal to the exterior surface of the optic of the lighting device then it is considered a normal refraction reference plane. There are numerous related refraction reference planes that can be constructed for each LED element. Each will intersect the optic to form a related refraction reference plane intersection optical contour which will define a related focal point. A related focal point defined by a related refraction reference plan is usually related only to that related LED element and need not lie on the bent focal line of the optics. If the related refraction reference plane is also coincident with the centerline of the optic, it will define a focal point which relates to that LED element and to the optic in general. In that case, the related focal point will lie on the bent focal line. Other optical characteristics of the lighting device including the index of refraction of the material used to construct lens or optic and the index of refraction of the surrounding mediums will have to be known in order for the intersection optical contour to finally define its related focal point. Each LED lamp has a LED element. A refraction reference plane that intersects a LED element also will intersect the optic to form an intersection optical or lens contour which can help define a related focal point. Thus for a particular LED lamp its LED element, related refraction reference plane, intersection optical contour and focal point are all related. The single first reference plane is common to all the LED lamps.

A focal point for the lighting device is defined as the point upon which a plurality of light rays approaching the optic from a distance parallel to the first reference plane and coincident with a particular refraction reference plane converge. The light rays will converge to define the focal point when they are refracted by the optic at the related intersection optical contour. If a plurality of refraction reference planes each coincident with the vertical centerline of the optic are each used to define a focal point, the locus of those focal points will be the bent focal line of the invention. Depending upon its contour and the selected refraction reference planes, a particular optic may have one or more focal points. In the current invention there are multiple focal points which may be discrete, connected to form a continuous curved line or connected to form a series of non-coliniar line segments. Prior art included a single focal point or a straight focal line.

Due to the characteristic directional but widely divergent spatial radiation pattern of the light emitted by the classical LED element each LED element will emit light into many of the related refraction reference planes that can be constructed intersecting that LED element. The light emitted into a particular related refraction reference plane will have a radiation pattern which originates at the LED element and is characterized by a peak intensity, a direction of peak intensity and a gradual intensity gradient. Determined by the intensity gradient, the intensity of the emitted light will usually decrease along directions which angularly diverge from the direction of peak intensity. The divergence or angular divergence of the radiation pattern within a reference plane is defined as the included angle between two directions of emitted light which represent intensities that are an arbitrary percentage of the peak intensity. This arbitrary percentage can be any selected value but is usually ten or fifty percent.

In the current application, we describe light being emitted by a LED element or LED lamp into a related refraction reference plane. Actually, a reference plane has no thickness and theoretically no light would be contained within it. Therefore, for this application references to light within a reference plane should be understood to be within a very thin infinitely long rectangular plate. The reference plane would be centered within the rectangular plate with the sides of the rectangular plate parallel to the reference plane.

The curved cylindrical optic of the current invention is designed to define a plurality of focal points, the locus of which is a focal line. The focal line is either curved or a series of non-coliniar straight line segments. This permits each of the LED lamps to have its LED element located at the focal point of at least one related refraction reference plane. Consequently, the light emitted by that LED lamp into that particular related refraction reference plane towards the optic will be refracted by the optic so that it emerges from the optic as an intense almost parallel group of light rays with minimal divergence about the horizontal plane.

Each LED light source is further oriented so that it directs light energy towards large portions of the optic including parts of the optic that define focal points separate from the location of the LED light source. As previously stated for each LED element a multitude of other related refraction reference planes can be constructed and the LED element will emit light into many of these other related reference planes. In actual practice, most of the light emitted by a LED element will be emitted into this group of other related refraction reference planes. These other related refraction reference planes may define their related focal points at a variety of locations. Obviously, if these related focal points are at separate locations the single related LED element can not be located at each of these separate focal points. Nevertheless, it has been found through testing that by using an optic with the proper shape, a single LED element can be located close enough to the focal points of this group of other related refractive reference planes such that the light emitted into each of these other related refractive reference planes is refracted by the optic of the lighting device to emerge from the lighting device with the necessary low angular divergence about the horizontal plane.

The light emitted from each of the individual LED lamps is refracted by the optic of the lighting device so that it emerges with a spatial radiation pattern that includes a first divergence in the first reference plane and a second and smaller divergence in a related refraction reference plane. Although the first reference plane can be any plane it is usually represented by the horizontal plane and the plurality of related refraction planes usually represented by a plurality of vertical planes. The optic of the current lighting device forms a single first reference plane intersection optical contour when intersected by the single first reference plane and a plurality of related refraction reference plane intersection optical contours when intersected by the plurality of related refraction reference planes.

The first reference plane intersection optical contour, the shape of each LED lamp body and the orientation of each LED element cooperate to refract and redirect light created by each LED element into a light pattern with a large magnitude of angular divergence in the first reference plane. The plurality of related reference plane intersection lens contours, the shape of each LED lamp body and the orientation of each LED element in relation to each of these contours similarly cooperate to refract and redirect light created by the LED element into a light output pattern with a small magnitude of angular divergence in the vertical plane. The small magnitude of angular divergence in the vertical plane corresponds to a high intensity as is usually required by specification. The small magnitude of angular divergence in the vertical plane can be restated as a small magnitude of angular divergence about the horizontal plane. The fact that the angular divergence in the horizontal plane permitted by the specification usually exceeds the angular divergence permitted in the vertical plane allows the horizontal or first reference plane intersection optical contour to be designed to create less refraction in the horizontal plane thereby reducing overall internal reflection at the interior surface of the optic. It also permits the body of the LED lamp to be designed to create less refraction in the horizontal plane reducing overall internal reflection within the LED lamp.

The curved focal line incorporated in the current invention permits each LED element to be at the focal point of one related refraction plane and close to the focal points of its other related refraction reference planes. If a LED element is located at the focal point of a normal related reference plane it will usually due to the geometry of the optic be located behind the focal points of its other related refraction planes. The magnitude of off-focus location of the light source in a particular related refraction reference plane will reduce the ability of the optic to acceptably concentrate the light within that related refraction reference plane. The greater this off-focus distance, the greater the difficulty in concentrating the light. Since the off-focus direction is usually behind the focal point of its other related refraction planes, the magnitude of the off-focus for the other related reference planes can be reduced by locating each LED element a slight distance on the lens side or in front of the focal point of its normal related refraction reference plane. This deliberate biasing of the position of the light source or LED element in front of the related focal point of the normal related refraction reference plane can beneficially reduce the magnitude of off-focus location that occurs in the other related reference planes.

Although it would appear to be necessary to locate a LED element exactly at one of its related focal points, it is not critical because only a very small quantity of light would pass through the infinitely thin section of the optic represented by a particular related refraction reference plane. It is however, critical that for each LED element the distances between that LED element and each of its related focal points be minimized. Furthermore, some related focal points should be given more importance within the design goal of minimizing the distance between a LED element and each of its related focal points. As previously described each LED element emits its light in a directional spatial radiation pattern. Therefore some related reference planes will be coincident with directions within the spatial radiation pattern that emit more light energy. These are the preferred related refraction reference planes and it is especially critical that the off-focus distance be minimized for the focal points defined by these preferred related refraction reference planes. Other related reference planes may be located along directions within the spatial radiation pattern that emit proportionally less of the emitted light. These related reference planes are not critical and for these the distance between the LED element and that related focal point is less important.

Finally, the direction of the off-focus distance is also a critical element in the design. A fixed off-focus axial displacement of the LED element within a related refraction reference plane directly towards or away from the related intersection optical contour will have a dramatic and deleterious effect upon the ability of the optic to concentrate the light. This axial off-focus displacement will increase the divergence about the horizontal plane of the light emerging from the optic. The same fixed off-focus displacement in a direction normal to the related refraction reference plane will be much more desirable. This lateral off-focus displacement will primarily shift the azimuthal direction of the light emerging from the optic with minimal increase in the divergence about the horizontal plane. The azimuthal shifting would not substantially reduce the intensity of the composite beam.

The light rays emitted by each LED lamp into the plurality of its related refraction reference planes are refracted by the optic to emit from the lighting device a projected spatial radiation pattern or projected light beam for that LED lamp. The projected spatial radiation patterns from the plurality of LED lamps combine to form a composite projected spatial radiation pattern for the entire lighting device. It is an object of this invention to contour the optic and orient each of the LED lamps relative to the optic to maximize the percentage of light emitted by each LED lamp which is acceptably concentrated by the optic into the composite projected light beam. This objective is facilitated by reducing the distance between each LED element and each focal point defined by the plurality of related reference planes.

Achieving an acceptably close relationship between each LED element and each of its related focal points can be more easily realized by locating each LED element along the locus of focal points of the optic and as close to each other as possible. The contour of the commercial LED lamp bodies can limit the designer's ability to place the LED elements in the desired close relationship. Modifying the shape of the base of the standard LED lamps into a wedge or taper advantageously permits the LED lamps and LED elements to be located at a reduced spacing on the locus of focal points. Redirecting the size of or even eliminating the individual LED lamp bodies would also permit reduced spacing.

In the current invention the body shape of each LED lamp would usually be designed to limit unnecessary refraction by the body of the LED lamp which would result in the apparent shifting or enlargement of the LED element. Avoiding apparent enlargement of the LED element is desirable because the optic of the lighting device relies on a small light source to remain effective in redirecting the light emitted by the LED lamps into the required concentrated output beam. The LED element is a small light source but it can appear large to the optic if it is refracted by the body of the LED lamp.

Avoiding apparent shifting of the location of the LED element beneficially permits the optic to be designed to control the light more efficiently. The optic must be designed to redirect the light rays from their apparent rather than their actual points of emission. If it appears to the optic that all of the light which it redirects is originating from a single concentrated location then the optic can more easily be designed to concentrate the light as necessary. The standard LED lamp includes a LED element and the light emitted from the LED element is emitted from a light source of limited size at one location. If the body of the LED lamp does not refract the light passing thru it the light emitted from the LED lamp will both be and appear to be emitted from the single limited size location. However, if the LED lamp body includes a light refracting lens then the light emerging from that lamp can appear to the optic to be emitted from a multiplicity of apparent locations. The distance between the actual and the apparent location for each light ray is determined by the shape of the LED lamp body at the point the light ray emerges from the LED lamp. The problem of apparent shifting of the emitted light will generally intensify as the LED body lens increases its degree of refraction. In the current application, the optic incorporates a curved focal line which substantially reduces or eliminate the need for a body lens on the LED lamp. Usually a spherical LED body shape which creates no refraction is the most desirable. This substantially reduces or even eliminates refraction caused by the LED lamp body in the first reference plane as well as the plurality of refraction reference planes. Other options such as flat top LED bodies locating the LED element within the LED lamp body or eliminating the LED body to reduce refraction would be acceptable methods for reducing internal reflection in the current invention. In those configurations of the current invention where there is apparent shifting of the location of the light source, the negative effect of this shifting can be reduced by positioning the LED lamp so that the apparent location of its light source is at the desired location relative to the focal line of the lighting device. In this design, the optical lens will still function acceptably well. If the apparent shifting of the light source varies so that it appears to the optical lens as a multiplicity of light sources at different locations then it is very difficult to reduce its negative effect.

Prior art designs use LED lamps with lens top bodies to substantially concentrate the light from the LED element before it impinges upon the optic. Furthermore, in prior art the LED body lens is dome shaped so that the light is refracted and concentrated equally in the horizontal and vertical planes by the LED lamp body lens. This is not desirable because in addition to the apparent shifting and enlargement problems previously mentioned, unnecessary refraction potentially increases the losses due to internal reflection at the surface of the lamp body. The unnecessary refraction is also not required because many specifications permit substantial divergence about the vertical plane for the composite projected light pattern. Therefore in the current application in those instances where it is necessary to use the body lens of the LED lamp to assist the optic in concentrating the light in the vertical plane the body lens creates reduced concentration in the horizontal plane.

The prior art use of LED lamps with domed lens top bodies creates additional problems. Each of the plurality of LED lamps includes a LED element which emits light with a directional widely divergent spatial radiation pattern including a peak intensity, a peak intensity direction, and a gradual intensity gradient. The prior art use of a circular formation of lens top LED lamps within a standard circular fresnel or buoy light lens incorporating a single central focal point creates dark zones in the composite output light beam because each functioning LED body lens projects a concentrated spot beam onto the inside surface of the buoy light lens. The dark zones between the concentrated light spots on the inside of the buoy light lens result in undesirable dark zones in the composite output beam. However, the dark zones can be eliminated if the LED lamps have a spherical body with the LED element at the center as described in one embodiment of the current invention. The spherical body does not function as a lens and the directional but very gradual intensity gradient characteristic of the LED element is maintained. By maintaining this directional but widely divergent spatial radiation pattern for each light source azimuthal directions between light sources obtain light energy from a multiplicity of LED lamps. Because of this, the interior surface of the curved optic between LED lamps is evenly illuminated by a plurality of LED lamps. This reduces intensity variations or dark zones between LED lamps in the projected composite beam. LED body shapes other than spherical can achieve similar results as long as the LED body lens does not excessively refract or concentrate the light in the first reference plane before it impinges upon the optic.

Concepts in this application are related to a U.S. patent application Ser. No. 08/144,653 for a multiple lamp lighting device filed on Oct. 28, 1993 and U.S. patent application Ser. No. 08/222,081 for an electronic wide angle lighting device filed on Apr. 4, 1994 both in the name of Kevin McDermott.

It is an object of the present invention to provide a lighting device that orients a plurality of LED light sources to cooperate with an optic designed to define multiple focal points to optimize the percentage of created light that emerges from the lighting device within a limited angle of divergence from a specified first reference plane.

It is a further object of the invention to provide a lighting device that efficiently uses a plurality of LED lamps with body shapes that reduce unnecessary refraction and internal reflection so that a curved optic can collect the emitted light and project a light beam with improved consistency of intensity throughout an elongated composite projected beam.

DESCRIPTION OF THE PREFERRED EMBODIMENT

Figure 1:
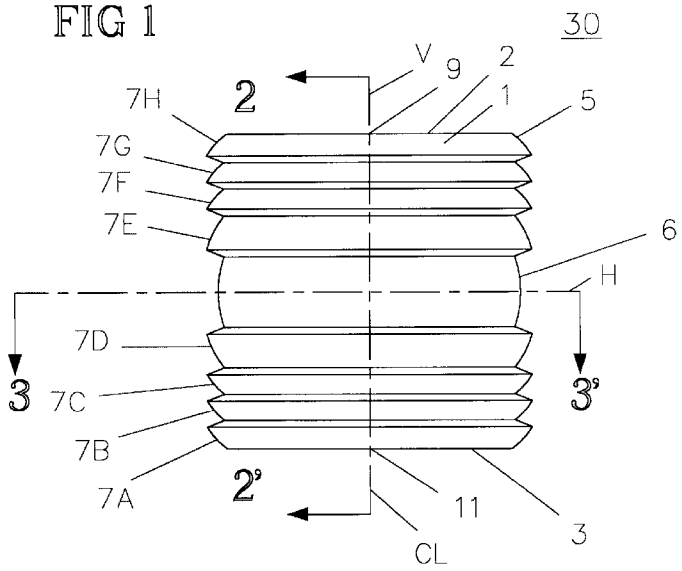
FIG. 1 is a front view of the preferred embodiment of the lighting device.

FIG. 1 is a front view of lighting device 30. The horizontal plane H and vertical plane V are shown for reference purposes and intersect to define the vertical centerline CL.

Figure 2:
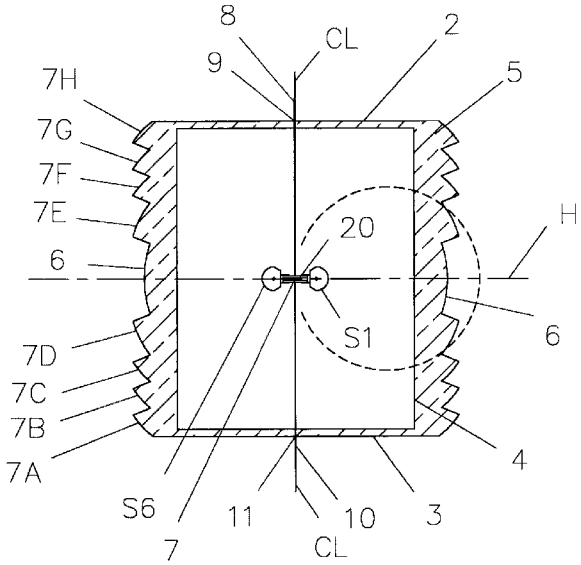
FIG. 2 is a cross-section view taken along line 2–2' of FIG. 1.

FIG. 2 is a cross-sectional view taken across line 2–2' of FIG. 1. Lighting device 30 includes housing 1 which is usually constructed of an optical grade plastic such as acrylic. Housing 1 comprises top surface 2, bottom surface 3, interior lens surface 4, and exterior lens surface 5. Exterior lens surface 5 incorporates central exterior lens surface 6 and optical steps 7A through 7H. Optical steps 7A thru 7H in combination with central exterior lens surface 6 represent a typical fresnel lens contour. This fresnel contour substitutes for a single curved exterior lens surface which would extend from top surface 2 to bottom surface 3. The single curved exterior lens surface would include a different curvature and thicker cross-section and therefore the detailed fresnel embodiment is the shape of choice. Vertical centerline CL is also the axis of revolution of housing 1 and it is perpendicular to horizontal plane H at point 7. Positive lead 8 is attached to top surface 2 at point 9 and negative lead 10 is attached to bottom surface 3 at point 11. Lamp assembly 20 is held in position within lighting device 30 by positive lead 8 and negative lead 10. Electrical power connected to positive lead 8 and negative lead 10 will energize lamp assembly 20.

Figure 3:
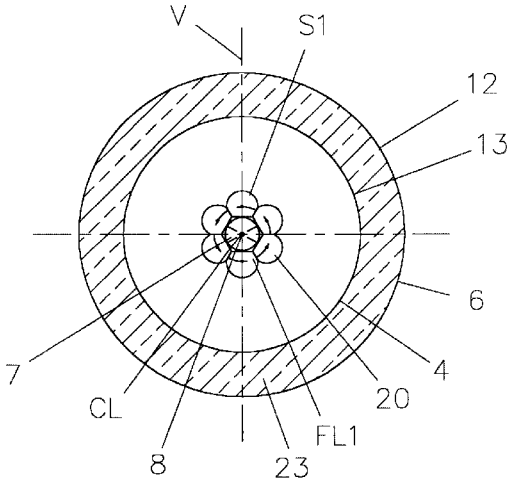
FIG. 3 is a cross-section view taken along line 3–3' of FIG. 1.

FIG. 3 is a cross-sectional view taken across line 3–3' of FIG. 1. In FIG. 3 horizontal plane H intersects central curved exterior lens surface 6 to form line 12 and interior lens surface 4 to form line 13. Lines 12 and 13 are both circular with a common center of curvature at point 7.

Figure 4:
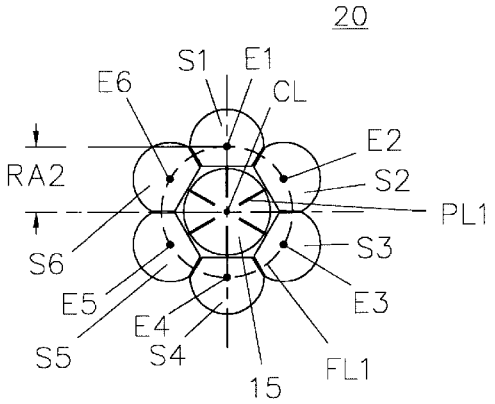
FIG. 4 is an enlarged view of the central portion of FIG. 3.
Figure 5:
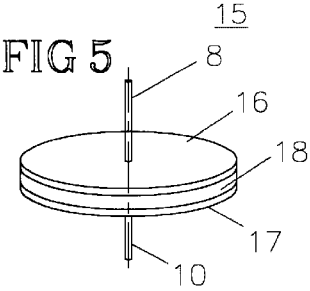
FIG. 5 is a perspective view of the circuit board removed from the FIG. 4 enlargement.

FIG. 4 is an enlarged view of lamp assembly 20 removed from the central section of FIG. 3. FIG. 5 is a perspective view of circuit board 15 removed from lamp assembly 20 of FIG. 4. Referring to FIGS. 3 through 5 circuit board 15 is centrally located within lamp assembly 20 and distributes power from positive lead 8 and negative lead 10 to each of the component LED lamps S1 thru S6. Circuit board 15 has a conductive top surface 16 electrically connected to positive lead 8 and conductive bottom surface 17 electrically connected to negative lead 10. Conductive surfaces 16 and 17 are separated by insulation 18.

Figure 6:
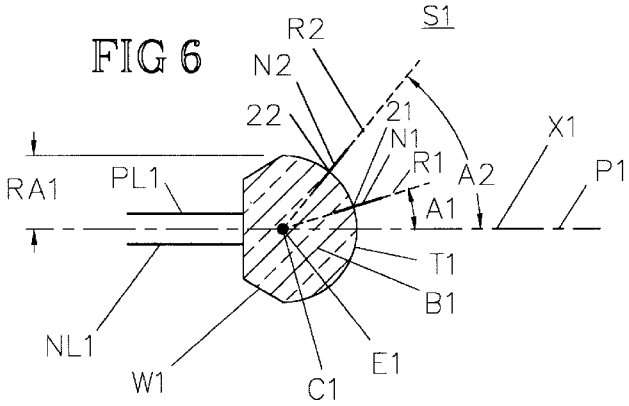
FIG. 6 is an illustrative view of a light emitting diode lamp removed from FIG. 4.

FIG. 6 is a diagrammatic side view of LED lamp S1 removed from lamp assembly 20 of FIG. 4. It is similar in construction to lamps S2 thru S6. LED lamp S1 includes LED element E1 encapsulated in transparent body B1 which is contoured about geometric body axis X1 to form spherical top surface T1 and chamfered base W1. Spherical top surface T1 has a radius RA1. For the purpose of this patent application we define the angular divergence of the spatial radiation pattern as the angle which includes all of the directions of intensity which exceed a stated percentage of the peak intensity. The angular divergence is applicable to a selected plane which intersects the light source and its value will usually change with the orientation of the selected plane. Usually, the stated percentage of peak intensity is fifty percent. However, ten percent is also used and as a practical matter any percentage can become a standard. Angular divergence can be applied to the spatial radiation pattern of the LED element or to the light after it emerges from the housing of the LED lamp or to the light after it emerges from the lens. If the spatial radiation pattern is concentrated such that the component light rays are substantially parallel then the term angular beamwidth can be substituted for the term angular divergence. LED element E1 typically emits light energy with a spatial radiation pattern that includes a peak intensity and a direction of peak intensity. Intensities along other directions are related to the angle between the direction of peak intensity and the selected direction. For some light sources, the intensity in a selected direction is proportional to the cosine of the angle between that direction and the direction of peak intensity. The spatial radiation pattern of LED element is a function of a number of characteristics of the design and therefore, spatial radiation patterns which do not conform to the cosine law are to be expected. Nevertheless, all of the spatial radiation patterns of LED elements are diverging in nature such that the light energy is spread out. For LED elements which follow the cosine law, the angular divergence using fifty percent of peak intensity is 60 degrees. For LED lamp S1 the geometric pattern axis P1 is the geometric axis of the spatial radiation pattern. Geometric pattern axis P1 is also along the direction of peak intensity. Also for LED lamp S1 geometric body axis X1 is coliniar with geometric pattern axis P1 of the spatial radiation pattern. Positive lamp lead PL1 and negative lamp lead NL1 provide a means to supply power to LED element E1. LED element E1 is located at the geometric center C1 of top spherical surface T1. A first typical light ray R1 emerging from LED element E1 at angle A1 relative to geometric pattern axis P1 intersects top spherical surface T1 at point 21 along normal N1 to that surface and therefore according to the basic laws of optical refraction passes through top spherical surface T1 unrefracted.

A second typical light ray R2 emerging from LED element E1 at angle A2 relative to geometric pattern axis P1 intersects top spherical surface T1 at point 22 along normal N2 to that surface is also unrefracted. In fact due to the contour of body B1 all light rays emitted by LED element E1 which directly intersect spherical top surface T1 intersect that surface substantially parallel to the normal to the surface at the point of intersection and pass through unrefracted. Thus spherical top surface T1 does not alter the spatial radiation pattern of the light impinging upon it. Hence for light passing through top spherical surface T1, the spatial radiation pattern of LED element E1 is the same as the spatial radiation pattern of LED lamp S1.

Each of the described light rays intersect their related normals to form an included angle which approximates 0 degrees. Since none of the included angles of intersection exceeds or even approaches the critical angle as defined in classical optics for total internal reflection there is minimal internal reflection within LED lamp S1 at spherical top surface T1. Spherical top surface T1 permits all of the light energy which impinges upon it to pass through it without significant losses due to internal reflection. After successfully emerging from LED lamp S1 without refraction or internal reflection, the light can be efficiently collected by the cylindrical lens as shown in FIG. 1. This would not be the case for LED lamps with integral body lenses designed to refract and concentrate the light that passes through them. These LED lamps, by means to be later described, cause light energy to be squandered by internal reflection and misdirection.

Looking at FIGS. 4 thru 6, typical LED lamp S1 has positive lamp lead PL1 soldered to conductive top surface 16 and negative lamp lead NL1 soldered to bottom conductive surface 17 of circuit board 15. Other LED lamps S2 thru S6 are similarly connected so that power supplied to power lead wires 8 and 10 of circuit board 15 is distributed to all of the LED lamps. This is a parallel circuit arrangement but a series circuit or other arrangements with different quantities of LED lamps can obviously be made by changing the shape of top conductive surface 16 and bottom conductive surface 17. Lamps S1 thru S6 are mounted in a circular formation equally angularly spaced. The LED elements E1 thru E6 are also diametrically spaced on circular focal line FL1 which has a radius RA2.

FIG. 4 shows six discrete LED elements E1 thru E6, each with their own lamp bodies. It would be advantageous for reasons to be later described to cast a single unitized body to encapsulate all six LED elements in a close relationship.

Figure 7:
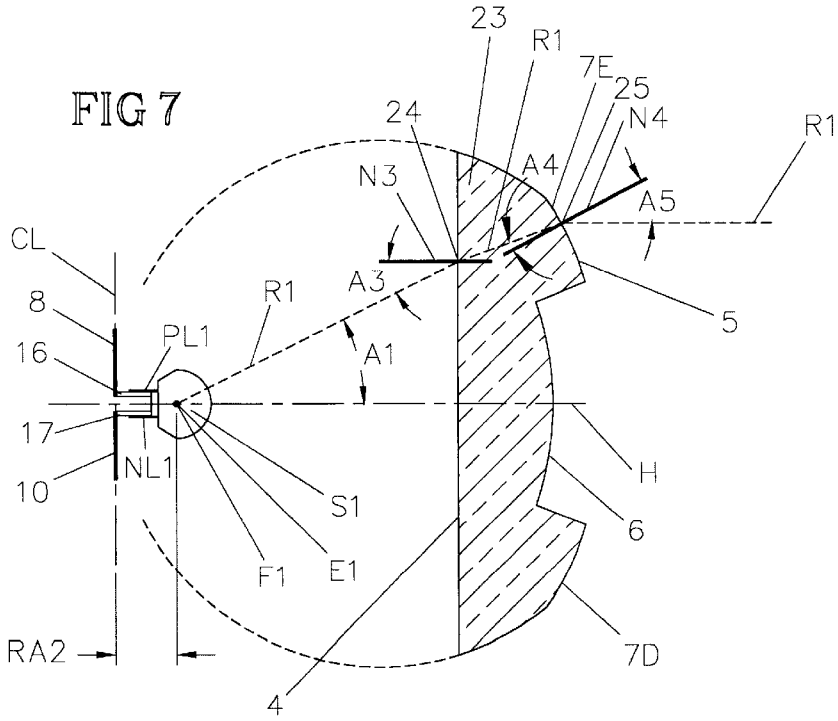
FIG. 7 is a diagrammatic enlargement of the central right portion of FIG. 2.

FIG. 7 is an enlarged view of the central right portion of FIG. 2. It shows the optics in the vertical plane V. The portion of housing 1 between interior lens surface 4 and exterior lens surface 5 is optic 23 of lighting device 30. Looking at FIG. 7 the horizontal plane H is functioning as the first reference plane and lighting device 30 is designed to collect the light emitted by LED lamps S1 thru S6 and redirect that light so that it emerges almost parallel to horizontal plane H. FIG. 7 is formed at the intersection of vertical plane V and housing 1 and the optical shape or contour between interior lens surface 4 and exterior lens surface 5 is the optical contour related to vertical plane V. Since vertical plane V passes through LED element E1 and is perpendicular to first reference or horizontal plane H, it is a related refraction reference plane. Since vertical plane V is also perpendicular to exterior lens surface 5, it is a normal related refraction reference plane for both LED element E1 and LED lamp S1. In this enlarged view typical light ray R1 as described in FIG. 6 is added shown emerging from LED lamp S1 and passing through the adjacent air with its direction unchanged until it intersects interior lens surface 4 at point of intersection 24. At point of intersection 24, it forms included angle A3 with normal N3 to interior lens surface 4. Light ray R1 is then refracted according to the basic laws of optics at interior lens surface 4 and passes directly through housing 1 until it intersects optical step 7E at point of intersection 25. At point of intersection 25 it forms included angle A4 with normal N4 to optical step 7E. Light ray R1 is then refracted according to the basic laws of optics at optical step 7E and emerges from housing 1 forming included angle A5 with normal N4. Emerging light ray R1 is substantially parallel to horizontal plane H. Light ray R1 emerges substantially parallel to horizontal plane H because LED element E1 lies on focal line FL1 and at the focal point F1 of the optical contour shown in FIG. 7. Other similar light rays such as light ray R2 of FIG. 6 in the same vertical plane as light ray R1 but emerging from LED lamp S1 at angles of elevation different then angle A1 will also emerge from housing 1 substantially parallel to horizontal plane H.

In this embodiment, optic 23 is contoured to define focal line FL1 of FIG. 4. Focal line FL1 is the locus of a group of individual focal points. Each individual focal point is defined by the optical contour created at the intersection of optic 23 and a refraction reference plane coincident with vertical centerline CL. A large number of refraction reference planes can be drawn coincident with vertical centerline CL and intersecting optic 23 and each defines an individual focal point. The individual focal points define focal line FL1. Since each of the LED elements E1 thru E6 lie on focal line FL1 each is therefore also positioned at the focal point of its normal related refraction reference plane. The light emitted from LED elements E2 thru E6 is refracted exactly as that described for LED element E1. Hence, within a vertical plane intersecting a particular LED element, perpendicular to the horizontal plane H and perpendicular to exterior lens surface 5 that intersected LED element projects its light energy towards a lens or optical contour which is designed to refract that light to make it emerge from the lens parallel to horizontal plane H.

Figure 8:
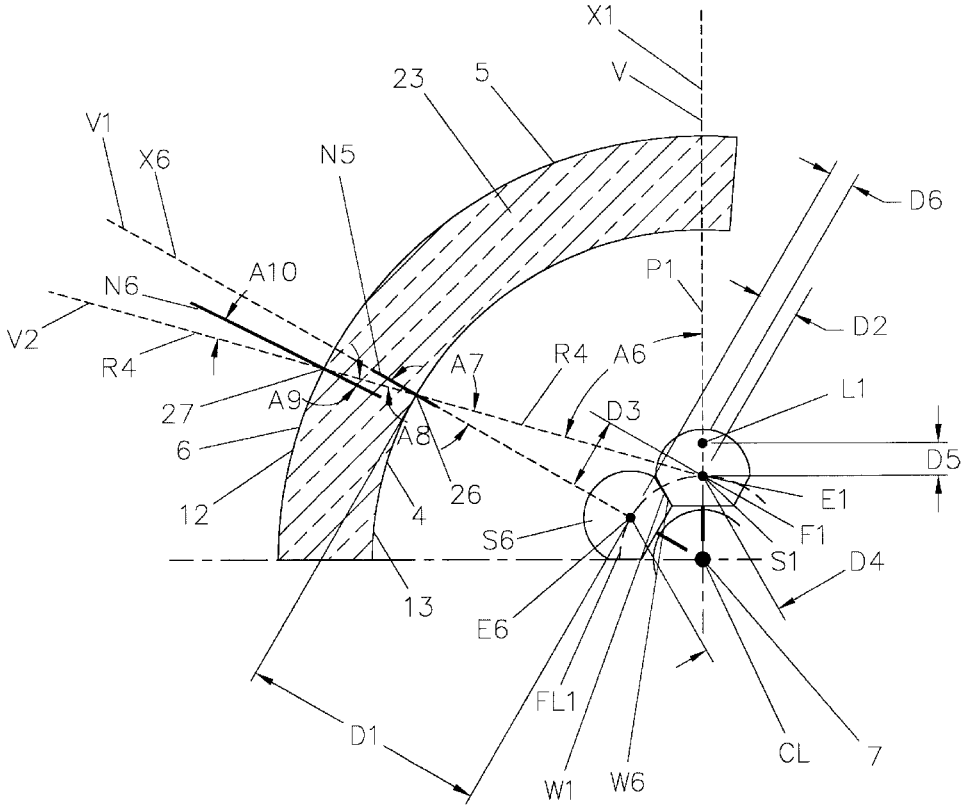
FIG. 8 is an enlarged view of the upper left quadrant of FIG. 3.

FIG. 8 is an enlarged view of the upper left quadrant of FIG. 3. In FIG. 8 we can see vertical plane V and LED lamp S1 which were discussed in FIG. 7. Also normal related refraction reference or vertical plane V1 for LED element E6 is shown. It can be seen that light from LED element E6 emitted into vertical plane V1 would after refraction by optic 23 emerge parallel to horizontal plane H for the same reasons given in the discussion relating to LED element E1 of FIG. 7. Even if all the light emitted by each LED lamp into its normal related refraction reference plane is redirected into the horizontal plane lighting device 30 can still fail to emit an acceptably intense light beam. Light energy which emerges from a LED lamp azimuthally diverging from its geometric axis represents a very high percentage of the light emitted from that lamp and therefore it is critical that this light be adequately redirected if the efficiency of lighting device 30 is to be maximized. Light energy emitted from LED element E1 within related refraction reference or vertical plane V2 is typical of this azimuthally diverging emitted light and light ray R4 is a typical azimuthally diverging light ray. Light ray R4 which leaves LED element E1 azimuthally diverging from its geometric axis X1 at angle A6 intersects interior lens surface 4 at point 26 forming included angle A7 with normal N5 to interior lens surface 4. It is refracted forming included angle A8 with normal N5. It then intersects exterior lens surface 5 at point of intersection 27 forming included angle A9 with normal N6 to exterior lens surface 5 and is refracted to emerge forming included angle A10 with normal N6. Emerging light ray R4 because of refraction at points of intersection 26 and 27 is slightly diverging from the azimuthal direction it had as it emerged from LED lamp S1. This change in azimuthal direction is not a problem because the light is simply spread in the horizontal plane H. Our design is attempting to minimize divergence of the emerging light about the horizontal plane H and this divergence has not increased.

Light ray R4 is refracted by the optical contour formed at the intersection of vertical plane V2 and optic 23. This contour is slightly different from the optical contour described in FIG. 7. Actually each related refraction reference plane which includes azimuthally diverging light rays will intersect optic 23 to create its own optical contour. That optical contour and the location of its related LED element will combine to determine if the light created by that LED element and emerging from lighting device 30 is acceptably concentrated about the horizontal plane H. Looking at LED element E6 it can be seen that the distance between point of intersection 26 and LED element E6 is distance D1. This represents a focal distance for the optical contour related to LED element E6 formed by the intersection of vertical plane V1 and optic 23. We can assume that light emitted from LED element E1 is refracted by an optical contour similar to that related to LED element E6 also at point of intersection 26. Relative to LED element E6 and its geometric axis X6, LED element E1 is displaced an axial distance D2 and a lateral distance D3. The lateral displacement distance D3 will shift the azimuthal direction of the light emerging from optic 23 but will not substantially increase its divergence about the horizontal plane. Since azimuthal shifts in direction are not critical the magnitude of lateral displacement distance D3 within certain limitations is not critical. The axial displacement distance D2 is more of a problem because it will increase the divergence about the horizontal plane H of the light emerging from optic 23.

Looking closely at FIG. 8 it can be seen that due to the shape of optic 23 the axial displacement distance D2 consistently increases as angle A6 increases. Thus if angle A6 is zero axial displacement distance D2 will be zero. As angle A6 increases axial displacement distance D2 increases along with it. Since it is our objective to minimize the magnitude of axial displacement distance D2 for all azimuthly diverging light rays we can shift the location of LED element E1 to compensate for expected increases in the axial displacement distance D2 that will be created as light rays emerge from LED lamp S1 at azimuthal angles of divergence. If LED element E1 is shifted from its current location on focal line FL1 to point L1 between focal line FL1 and optic 23 it will no longer be at the focal point of the optical contour as described in FIG. 7 and light ray R1 of FIG. 7 will not emerge parallel to the horizontal place H. This is a disadvantage of shifting the location of LED element E1. However other light rays such as light ray R4 in FIG. 8 which emerge azimuthly diverging from LED lamp S1 will after passing through optic 23 emerge more parallel to horizontal plane H. This occurs because the axial displacement distance for an azimuthly diverging light ray R4 emerging from LED element E1 located at point L1 will have an axial displacement distance D6 which is substantially smaller then axial displacement distance D2. This shifting technique has been found through experiment to create a substantial reduction in the angular divergence about the hornziontal plane H of the light emerging from lighting device 30.

LED lamps S1 and S6 are positioned so that they are separated by distance D4. Distance D4 is minimized by positioning LED lamps S1 and S6 so that their wedge bases W1 and W6 are in contact. The wedge base body design permits this close relationship and the corresponding reduction in separation distance D4. Since axial displacement distance D2 and lateral displacement distance D3 are related to separation distance D4 minimizing distance D4 generally reduces these distances. Therefore, any means that can be employed to locate the LED elements close together will reduce the axial displacement distance D2 and correspondingly reduce the angular divergence about the horizontal plane of the light emerging from lighting device 30. The use of wedge base body lamps or the elimination of the lamp body or the use of a unitized lamp body all can be used to reduce the separation distance between the LED elements.

Figure 9:
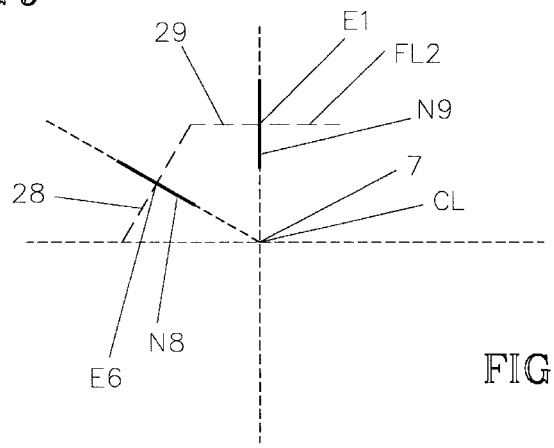
FIG. 9 is an illustrative view of an alternate shape bent focal line.

FIG. 9 illustrates an alternate focal line FL2 composed of straight line segments which could replace focal line FL1 of FIG. 8. An acceptable alternate shape for optic 23 could be designed using classical optics to define focal line FL2 in place of curved focal line FL1 of FIG. 8. FIG. 9 shows focal line FL2 formed of straight line segments 28 and 29. These segments are angled so that their normals N8 and N9, respectively, converge and intersect at point 7 on centerline CL. In this particular alternate focal line design it would take six line segments to substitute for the entire circle of focal line FL1. Using straight line segments as indicated by focal line FL2 still tends to achieve one of the objectives of the preferred embodiment in that it tends to minimize the variation in the distance between the apparent point of emission of the light and the intersected optical contour for light leaving the LED lamp azimuthally diverging from its axis. Using additional but shorter straight line segments will more closely approximate the curved focal line FL1 of FIG. 8.

Figure 10:
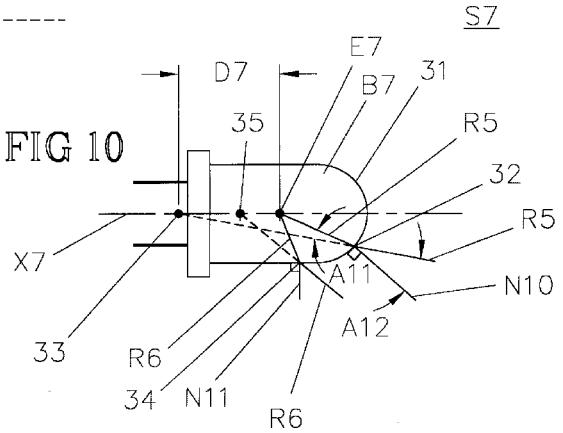
FIG. 10 is an illustrative view of a light emitting diode lamp with a lens incorporated into its body.

FIG. 10 is an enlarged diagrammatic side view of LED lamp S7 which can be substituted for LED lamp S1 as shown in FIG. 6. LED lamp S7 is typical commercial T 1 ¾ LED lamp. LED lamp S7 includes body B7, geometric body axis X7 and LED element E7. Body B7 includes light condensing lens 31 which is designed to refract light rays leaving body B7 such that they emerge from LED lamp S7 more parallel to geometric axis X7. Light ray R5 is emitted from LED element E7 towards lens 31. It intersects lens 31 at point of intersection 32 and forms included angle A11 with normal N10 to lens 31 at point of intersection 32. According to the basic laws of optics light ray R5 is refracted to emerge from lens 31 forming included angle A12 with normal N10. Due to the refraction at lens 31 refracted emerging light ray R5 is more parallel to geometric body axis X7. If refracted light ray R5 is projected back into LED lamp S7 it intersects geometric body axis X7 at apparent point of emission 33. LED lamp S7 has only one actual LED element E7 and therefore only one point of light emission. However, due to lens 31 light ray R5 appears to originate from a location separated from the location of LED element E7. Distance D7 represents the separation between the actual point of emission of light ray R5 and its apparent point of emission 33. It is also the distance between the location of point of apparent emission 33 and the location of LED element E7. A second light ray R6 is also emitted from LED element E7. It does not intersect lens 31 but intersects the side of body B7 at point of intersection 34 where it is refracted relative to normal N11 to emerge as refracted light ray R6. If refracted light ray R6 is projected back into LED lamp S7 it intersects geometric body axis X7 at apparent point of emission 35. Apparent point of emission 35 is separated from apparent point of emission 33. If LED lamp S7 is substituted for LED lamp S1 in the FIG. 8 embodiment of the current invention optic 23 will refract light emerging from LED lamp S7 as if it were emerging from apparent point of emission 33. Therefore lamp S7 will have to be located relative to focal line FL1 based upon its apparent point of light emission rather than the actual location of LED element E7. In the FIG. 8 embodiment LED lamp S1 includes a spherical body which does not refract the emerging light. Therefore, its apparent point of emission is at its actual point of emission at the location of LED element E1. In the FIG. 8 embodiment, LED element E1 is located relative to focal line FL1 to achieve the light output as described. If LED lamp S7 is substituted for LED lamp S1, then apparent point of emission 33 rather than LED element E7 would be located in the described relationship with focal line FL1. Light leaving LED lamp S7 through the side of body B7 will have an apparent point of emission at a variety of locations depending upon where on body B7 it emerges from LED lamp S7. Since optic 23 cannot properly redirect this light, it will be squandered. LED lamps similar to LED lamp S7 can be substituted for lamps S1 thru S6 in FIG. 4. Also other LED lamps with alternate body shapes can be employed. Whenever alternate body shapes are employed their apparent points of light emission must be correctly located relative to focal line FL1.

Having now fully set forth the preferred embodiments and certain modifications of the concept underlying the present invention, various other embodiments as well as certain variations and modifications of the embodiment herein shown and described will obviously occur to those skilled in the upon becoming familiar with said underlying concepts. For instance, although this disclosure centered on visible light, the concepts described and the term light are meant to include all electromagnetic radiated energy including the infrared portion of the spectrum. In addition, although most designs would use LED lamps with discrete housings which are readily available, many of the concepts can be applied using luminescent elements without housings.

It is to be understood, therefore, that within the scope of the appended claims, the invention may be practiced otherwise then as specifically set forth.

What is claimed is:

1. A lighting device comprising a plurality of light sources disposed in a common horizontal plane about a vertical axis, each said light source including a light emitting diode element in said horizontal plane for emitting a light in a diverging pattern about said horizontal plane; and a curved optical lens disposed about said vertical axis and intersecting said horizontal plane, said lens having a plurality of focal points for effecting a concentration of light from said light sources about said horizontal plane, each said focal point being disposed in a vertical plane passing through said vertical axis perpendicularly of said horizontal plane; wherein each said light emitting diode element is positioned in a respective vertical plane at a greater distance from said vertical axis than said respective focal point in said respective vertical plane to minimize divergence of light from said respective light emitting diode element about said horizontal plane.

2. A lighting device as set forth in claim 1 wherein each said light source includes a light transmitting body encapsulating said light emitting diode element and defining a lens at a surface thereof for refracting light from said element towards said horizontal plane.

3. A lighting device as set forth in claim 1 wherein said light sources are radially distributed in said horizontal plane about said vertical axis and wherein said lens in a cylindrical fresnel lens.

4. A lighting device as set forth in claim 1 wherein each light source is an infrared light source.

5. A lighting device as set forth in claim 1 wherein said lens has a fresnel lens contour on an exterior surface thereof.

6. A lighting device as set forth in claim 1 wherein each light source includes a light transmitting body of spherical contour with said light emitting diode element disposed at a center of said contour.

7. A lighting device as set forth in claim 1 wherein each light source includes a light transmitting body encapsulating said light emitting diode element and having a wedge shaped base abutting an adjacent light source in mating relation.

8. A lighting device as set forth in claim 1 wherein each light emitting diode element emits light in a spatial radiation pattern having a gradual intensity gradient.

9. A lighting device as set forth in claim 1 wherein each light emitting diode element emits light in a widely divergent spatial radiation pattern.

10. A lighting device as set forth in claim 1 further comprising a unitized body connecting said light sources.

11. A lighting device as set forth in claim 1 wherein said focal points of said lens are disposed on a curved line having a center of curvature on said vertical axis.

12. A lighting device comprising a plurality of light sources disposed in a common horizontal plane and spaced about a vertical axis for emitting a light in a diverging pattern about said horizontal plane, each said light source including a light emitting diode element disposed in a vertical plane coincident with said vertical axis; and a lens disposed about said vertical axis and intersecting said horizontal plane, said lens having a point in each said vertical plane for each said light source for maximizing a concentration of light from said light source in said respective vertical plane about said horizontal plane; wherein each said light source is located at a greater distance from said vertical axis than said respective point to decrease said concentration of light in said vertical plane while increasing a concentration of the total light from said light source about said horizontal plane.

13. A lighting device as set forth in claim 12 wherein each light source includes a lens for refracting light from said light emitting diode element towards said horizontal plane, said light from each said light source having an apparent point of emission in said respective vertical plane and wherein each said light source is located with said apparent point of emission thereof located at a greater distance from said vertical axis than said respective point to maximize a concentration of the total light from said light source about said horizontal plane.

14. A lighting device as set forth in claim 13 wherein each said point of said lens is a focal point.

15. In a lighting device, the combination comprising at least one light source disposed in a horizontal plane in spaced relation to a vertical axis for emitting a light in a diverging pattern about said horizontal plane, said light source including a light emitting diode in a vertical plane coincident with said vertical axis; and a lens spaced from said vertical axis and intersecting said horizontal plane, said lens having a point for maximizing a concentration of light from said light source in said vertical plane about said horizontal plane; wherein said light source is located at a greater distance from said vertical axis than said point to decrease the concentration of light in said vertical plane from said light emitting diode element about said horizontal plane while increasing a concentration of the total light from said light source about said horizontal plane.

16. The combination as set forth in claim 15 wherein said light source has a lens for refracting light from said element towards said horizontal plane, said light from said light source having an apparent point of emission in said vertical plane and wherein said apparent point of emission of said light source is located at a greater distance from said vertical axis than said point to maximize a concentration of the total light from said light emitting diode element about said horizontal plane.

17. The combination as set forth in claim 16 wherein said point of said lens is a focal point.

18. In a lighting device, the combination comprising at least one light source disposed in a horizontal plane in spaced relation to a vertical axis, said light source including a light emitting diode element in said horizontal plane for emitting a light in a diverging pattern about said horizontal plane; and an optical lens spaced from said vertical axis and intersecting said horizontal plane, said lens having a focal point for effecting a concentration of light from said light source about said horizontal plane, said focal point being disposed in a vertical plane passing through said vertical axis perpendicularly of said horizontal plane; wherein said light emitting diode element is positioned in a respective vertical plane at a greater distance from said vertical axis than said focal point in said respective vertical plane to minimize divergence of light from said respective light emitting diode element about said horizontal plane.

19. A lighting device as set forth in claim 12 wherein said light source includes a light transmitting body encapsulating said light emitting diode element and defining a lens at a surface thereof for refracting light from said element towards said horizontal plane.

20. The combination as set forth in claim 18 wherein said lens in a curved fresnel lens.

21. The combination as set forth in claim 18 wherein said light source is an infrared light source.

22. The combination as set forth in claim 18 wherein said light emitting diode element emits light in a spatial radiation pattern having a gradual intensity gradient.

23. The combination as set forth in claim 18 wherein each light emitting diode element emits light in a widely divergent spatial radiation pattern.

* * * * *

UNITED STATES PATENT AND TRADEMARK OFFICE

CERTIFICATE OF CORRECTION

PATENT NO. : 6,048,083

DATED : April 11, 2000

INVENTOR(S) : KEVIN MCDERMOTT

It is certified that error appears in the above-indentified patent and that said Letters Patent is hereby corrected as shown below:

Column 3, line 13 change "construct" to -construct the-
Line 43 before "each" insert -,-

Column 5, line 12 after "usually" insert -,-; after "optic" Insert -,-

Column 11, line 52 after "plane" insert -,-

Column 12, line 64 change "hornziontal" to -horizontal-

Signed and Sealed this

Thirteenth Day of March, 2001

*Attest:*

Nicholas P. Godici

NICHOLAS P. GODICI

*Attesting Officer*

*Acting Director of the United States Patent and Trademark Office*